United States Patent [19]

Washburn

[11] Patent Number: 4,555,477

[45] Date of Patent: Nov. 26, 1985

[54] PHOTOGRAPHIC ELEMENT AND PROCESS UTILIZING METAL COMPLEX COLOR MASKING DYES

[75] Inventor: William N. Washburn, Ionia, N.Y.

[73] Assignee: Eastman Kodak Company, Rochester, N.Y.

[21] Appl. No.: 688,479

[22] Filed: Jan. 2, 1985

[51] Int. Cl.[4] ..... G03C 1/40; G03C 7/18

[52] U.S. Cl. ..... 430/359; 430/367; 430/375; 430/378; 430/542; 430/543; 430/559; 430/547

[58] Field of Search ..... 430/359, 375, 367, 378, 430/542, 543, 559, 222, 226, 547, 548, 381

[56] References Cited

U.S. PATENT DOCUMENTS

| | | | |
|---|---|---|---|
| 2,449,966 | 9/1948 | Hanson, Jr. | 430/359 |
| 2,533,182 | 12/1950 | Sargent | 430/375 |
| 4,142,891 | 3/1979 | Baigrie et al. | 430/223 |

FOREIGN PATENT DOCUMENTS

| | | |
|---|---|---|
| 59-44773 | 3/1984 | Japan . |
| 701843 | 1/1954 | United Kingdom . |

OTHER PUBLICATIONS

*Research Disclosure*, publication 17643, paragraph VII, Dec. 1978.

Schilt, *Talanta*, 13, pp. 895–902, (1966).

*Primary Examiner*—Richard L. Schilling

*Attorney, Agent, or Firm*—J. Lanny Tucker

[57] ABSTRACT

A process of obtaining highly stable color masking dyes comprises use of an element which has a support having thereon at least one silver halide emulsion layer having associated therewith an essentially colorless, immobile, ligand-releasing compound of the structure LIG-X. In this structure, X is a group which, as a function of silver halide development, is cleaved from LIG, and LIG is a ligand capable of complexing with metal ions while joined to X to form a color masking dye. A color masking dye is formed by developing the imagewise exposed areas of the described element with a developing agent to cleave LIG from X and washing substantially all of the cleaved LIG moieties in those areas out of the element, and treating the element with metal ions to form a masking dye complex with LIG-X in unexposed areas.

15 Claims, No Drawings

PHOTOGRAPHIC ELEMENT AND PROCESS UTILIZING METAL COMPLEX COLOR MASKING DYES

REFERENCE TO RELATED APPLICATIONS

This application is related to the following commonly assigned applications, all filed on even date herewith: U.S. Ser. No. 688,477 by F. V. Lovecchio, J. A. Reczek and R. C. Stewart, U.S. Ser. No. 688,478 by J. A. Reczek and J. M. Palumbo, and U.S. Ser. No. 688,224 by W. N. Washburn and K. R. Hollister.

FIELD OF THE INVENTION

This invention relates to color photography. In particular, it relates to photographic elements containing essentially colorless, immobile, ligand-releasing compounds and a process of using same to provide color masking dyes for color correction.

BACKGROUND OF THE INVENTION

It is known that dyes used in multicolor photographic elements do not transmit all of the electromagnetic radiation desired by theoretical photographic considerations. For example, the cyan dye, which should absorb radiation in the red region and transmit radiation in the green and blue regions of the electromagnetic spectrum, usually absorbs a small amount of radiation in the latter regions as well. The magenta and yellow dyes commonly used also exhibit undesirable absorptions. The result of printing a multicolor image formed with such dyes is to introduce undesirable amounts of color image regardless of the printing process parameters and sensitivity of the element. Color correction is therefore desirable and is generally accomplished with masking in some manner.

U.S. Pat. No. 2,449,966 (issued Sept. 21, 1968 to W. T. Hanson, Jr.) and the art mentioned therein describe various means for color correction of multicolor photographic elements, including the use of preformed dyes. *Research Disclosure,* publication 17643, paragraph VII, December, 1978 and references described therein also describe color masking dyes. (*Research Disclosure* is available from Kenneth Mason Publications, Ltd., The Old Harbourmaster's, 8 North Street, Emsworth, Hampshire P010 7DD, United Kingdom). However, most performed dyes commonly used for color correction are already colored at the time of imagewise exposure. If such dyes and silver halide are incorporated in the same layer of a multicolor photographic element, the dye will act as an unwanted filter, absorbing a portion of the incident radiation which otherwise would reach the silver halide. This results in a loss of sensitivity (i.e. photographic speed). One way to avoid this problem is to put masking dyes in only one layer of the multicolor elements which generally have three color-forming layers. This solution is not desirable if masking is needed in the other layers. Another way to eliminate the unwanted filtering effect is to have the silver halide and the dye in separate layers while maintaining them in reactive association. While this is a useful and practical solution, it increases the number of layers in the element, making it thicker and presenting manufacturing and imaging inefficiencies.

Hence, it would be desirable to form highly stable color masking dyes using dye precursors which are essentially colorless prior to imagewise exposure and development and can be placed in any and all layers of a multicolor photographic element.

SUMMARY OF THE INVENTION

The present invention provides photographic elements which contain highly stable, essentially colorless compounds which can be used to provide color masking of unwanted absorption. These elements and the process of using same provide desirable versatility in the placement of the dye-providing compounds described herein in any or all layers of the elements because they are essentially colorless until development with development compositions after imagewise exposure and until treatment with metal ions. Hence, the problems often encountered with known color masking dyes are avoided.

Therefore, in accordance with this invention, there is provided a photographic element which comprises a support having thereon at least one silver halide emulsion layer having associated therewith a compound for providing a dye image in exposed areas of the elements, and an essentially colorless, immobile, ligand-releasing compound of the structure LIG-X. In this structure, X is a group which, as a function of silver halide development, is cleaved from LIG, and LIG is a ligand capable of complexing with metal ions while joined to X to form a color dye image in the unexposed areas of the element.

This invention also provides a process of color correction in the above-described element which has been imagewise exposed. This process comprises the steps of (a) developing the imagewise exposed areas of the element with a color developing agent, thereby cleaving LIG from X and washing substantially all of the cleaved LIG out of the element; and (b) treating the element with metal ions to form a color masking dye with LIG-X in the unexposed areas of the element.

DETAILED DESCRIPTION OF THE INVENTION

The advantages described above for this invention are attained because of the use of the essentially colorless, immobile, ligand-releasing compound represented as LIG-X. The compounds LIG-X are "essentially colorless", meaning that prior to complexation of the LIG moiety with metal ions to form a visible dye, LIG-X exhibits essentially no observable color. That is, LIG-X exhibits a low optical density (i.e. less than about 0.05), although it may emit or reflect electromagnetic radiation in the non-visible portions of the electromagnetic spectrum. Therefore, the LIG moiety and the metal ions "form" a colored dye from a colorless precursor, as opposed to compounds which are merely shifted in their absorption $\lambda_{max}$ upon complexation with a metal ion to provide a dye of a *different* color.

LIG is a moiety, which when complexed with one or more metal ions, forms a visible dye. This metal-LIG complexation occurs while LIG is joined to X in the unexposed areas of the element. In exposed areas, LIG is cleaved from X by oxidized developing agent and substantially all of the cleaved LIG moiety is subsequently washed out during processing. Therefore, LIG is a moiety which is soluble enough to be washed out of the element once it is cleaved from X. In the unexposed areas, the remaining LIG-X compound is treated with metal ions (e.g. ferrous ions) which complex with the uncoupled LIG moiety to provide a visually colored masking dye.

Generally, the dyes formed upon complexation of the LIG moiety and metal ions are visibly colored dyes. That is, they absorb electromagnetic radiation in the visible portion of the electromagnetic spectrum, i.e. between about 400 and about 700 nm. More than one molecule of a LIG moiety can be complexed with one metal ion. For example, there may be two or three LIG molecules complexed with a single metal ion. Representative dyes which can be formed are cyan, yellow and magenta dyes.

Useful LIG moieties can be obtained from ferroin type compounds such as hydrazones, tetrazolylpyridines, pyridylquinazolines, bis-isoquinolines, imines, phenanthrolines, bipyridines, terpyridines, bidiazines, pyridyldiazines, pyridylbenzimidazoles, diazyltriazines, o-nitrosoanilines and phenols, tetrazines, triazines described by Schilt et al in the journal *Talanta,* 15, pp. 475–478 (1968), pyridine derivatives of phenazine and quinoxaline described by Schilt et al in *Talanta,* 15, pp. 852–855 (1968), substituted benzimidazole derivatives as described by Schilt et al, *Talanta,* 15, pp. 1055–1058 (1968), oximes of substituted methyl and phenyl 2-pyridyl ketones as described by Schilt et al, *Talanta,* 16, pp. 448–452 (1969), and the like. Other ligand-providing compounds are described in the following *Talanta* literature articles: 16, pp. 519–522 (1969), 13, pp. 895–902 (1966), 17, pp. 649–653 (1970), 19, pp. 1025–1031 (1972), 21, pp. 831–836 (1974), 22, pp. 915–917 (1975), 23, pp. 543–545 (1976), 24, pp. 685–687 (1977), 26, pp. 85–89 (1979), pp. 863–865 (1981), 36, pp. 373–376 (1979), 55, pp. 55–58 (1980), 29, pp. 129–132 (1982), and in Blandamer et al, *J. Chem. Soc. Dalton,* pp. 1001–1008 (1978), and Case, *J. Org. Chem.,* 31, pp. 2398–2400 (1966). The terpyridines are particularly useful for obtaining magenta masking dyes.

Particularly useful LIG moieties are those derived from compounds represented by the structure:

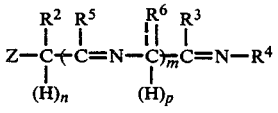

wherein m is 0 or a positive integer 1 to 3, n and p are independently 0 or 1, and ⎓ represents a single or double bond.

Z is $R^1$—N=, O=, S=, $R^1$—P=, $(R^1)_2P$— or $(R^1)_3P$=. When Z is $(R^1)_2P$—, n is 1, otherwise n is 0. Preferably, m is 0 or 1 and Z is $R^1$—N=.

$R^1$, $R^2$, $R^3$, $R^4$, $R^5$ and $R^6$ are independently hydrogen, amino (primary, secondary or tertiary), hydroxy, mercapto, alkoxy (preferably of 1 to 20 carbon atoms, e.g. methoxy, chloromethoxy, ethoxy, octyloxy, alkoxy substituted with imino, etc.), alkyl (preferably of 1 to 20 carbon atoms in the nucleus, e.g. methyl, ethyl, chloromethyl, isopropyl, t-butyl, heptyl, alkyl substituted with imino, etc.), aryl (preferably of 6 to 14 carbon atoms, e.g. phenyl, naphthyl, xylyl, p-methoxyphenyl, aryl substituted with imino, etc.), or a heterocyclic moiety (preferably having 5 to 20 carbon, nitrogen, sulfur or oxygen atoms in the nucleus, e.g. pyridyl, quinolyl, a heterocycle substituted with imino, etc.).

When $R^6$ is a group defined above, p is 1 and ⎓ is a single bond.

Alternatively, if m is 0, $R^1$ and $R^2$, $R^2$ and $R^3$, and $R^3$ and $R^4$, taken together, can independently represent the carbon and heteroatoms (e.g. nitrogen, oxygen, sulfur, selenium, etc.) necessary to complete a substituted or unsubstituted 5 to 20 membered mono- or polycyclic carbocyclic or heterocyclic group (e.g. pyridine, quinolyl, triazinyl, phenanthrolinyl, pyrimidyl, etc.). The heterocyclic nucleus so formed can be substituted with one or more oxo, alkyl, amino, imino, aryl, phosphino (e.g. diphenylphosphino), alkoxy, amide, sulfonamide, thio or sulfo groups as defined above, or a heterocyclic group (e.g. pyridyl, pyrimidyl, thiazolyl, imidazolyl, thienyl, etc.).

If m is 1, 2 or 3, $R^1$ and $R^2$, $R^5$ and $R^6$, and $R^3$ and $R^4$, taken together, can independently represent the carbon and heteroatoms (e.g. nitrogen, oxygen, sulfur, selenium, etc.) necessary to complete a substituted or unsubstituted 5 to 20 membered mono- or polycyclic heterocyclic nucleus as defined above where m is 0. When $R^5$ and $R^6$ are so defined, p is 0 when ⎓ is a double bond, and p is 1 when ⎓ is a single bond.

Preferably, LIG is sufficiently soluble in processing solutions that when it is cleaved from X, it can be washed out of the element. If desired, LIG can contain one or more solubilizing groups, e.g. sulfate, sulfonate, carboxylate, hydroxy or phosphate groups, to give it suitable solubility.

Examples of useful LIG moieties which form color dye complexes with ferrous ions are shown below. In these structures, the point of attachment to X is represented by an unsatisfied bond. The $\lambda_{max}$ of each resulting ferrous ion-complex dye is also noted, however, the $\lambda_{max}$ can be shifted somewhat (e.g. 10–15 nm) depending upon the X moiety to which LIG is attached.

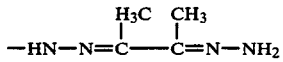

yellow, $\lambda_{max}$ = 442 nm

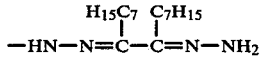

yellow, $\lambda_{max}$ = 443 nm

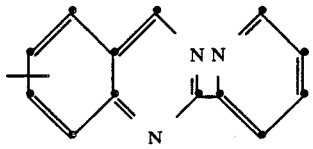

yellow, $\lambda_{max}$ = 441 nm

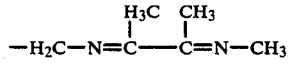

magenta, $\lambda_{max}$ = 564 nm

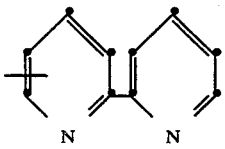

red, $\lambda_{max}$ = 522 nm

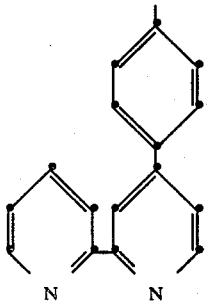

magenta, $\lambda_{max}$ = 536 nm

-continued

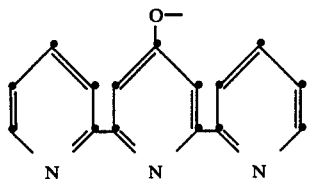

magenta, $\lambda_{max}$ = 552 nm

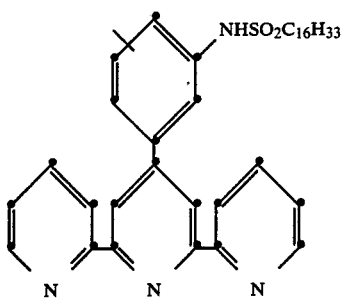

magenta, $\lambda_{max}$ = 571 nm

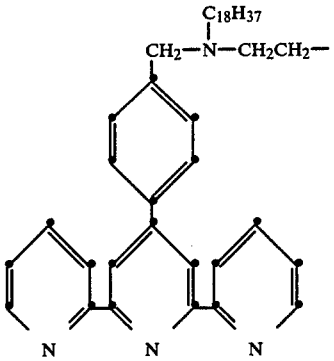

magenta, $\lambda_{max}$ = 567 nm

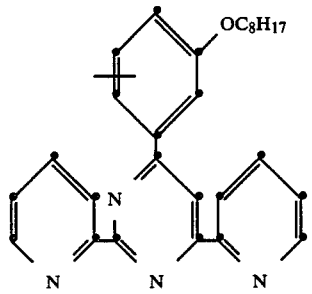

magenta, $\lambda_{max}$ = 583 nm

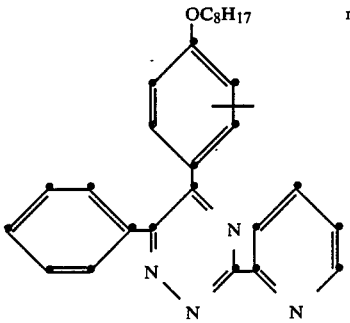

magenta, $\lambda_{max}$ = 557 nm

-continued

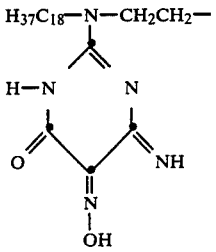

cyan, $\lambda_{max}$ = 644 nm

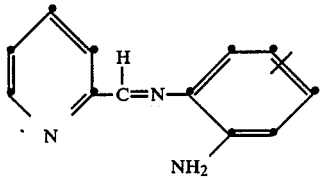

cyan, $\lambda_{max}$ = 670 nm
and

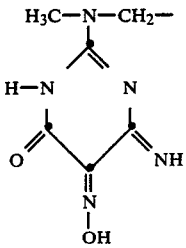

cyan, $\lambda_{max}$ = 650 nm.

X is any moiety which will react with oxidized developing agent (e.g. oxidized color developing agent). In preferred embodiments, it is a coupler moiety derived from conventional color-forming couplers which yields a colored product on reaction with oxidized color developing agents or which yields a colorless product on reaction with oxidized color developing agents. Both types of coupler moieties are well known to those skilled in the photographic art and described, for example, in *Research Disclosure,* publication 17643, paragraph VII, December, 1978, and references noted therein. *Research Disclosure* is available from Kenneth Mason Publications, Ltd., The Old Harbourmaster's, 8 North Street, Emsworth, Hampshire P010 7DD, United Kingdom.

However, useful results can be obtained with this invention when X is another moiety known in the art to release dyes, or other photographically useful fragments as a result of silver halide development. Such moieties include redox dye releasers and similar compounds as described, for example, in U.S. Pat. No. 4,053,312 (issued Oct. 11, 1977 to Fleckenstein), U.S. Pat. No. 4,055,429 (issued Oct. 25, 1977 to Holmes et al), U.S. Pat. No. 4,076,529 (issued Feb. 28, 1978 to Fleckenstein, U.S. Pat. No. 4,139,379 (issued Feb. 13, 1979 to Chasman et al), U.S. Pat. No. 4,139,389 (issued Feb. 13, 1979 to Hinshaw et al), U.S. Pat. No. 4,199,354 and U.S. Pat. No. 4,199,355 (both issued Apr. 22, 1980 to Hinshaw et al), and U.S. Pat. No. 4,232,107 (issued Nov. 4, 1980 to Janssens).

In certain embodiments, X can contain a ballast group which renders LIG-X and uncoupled X nondiffusible in the photographic element during processing. The ballast group can be an organic nonpolymeric or polymeric ballasting group of such molecular size and configuration as to render the LIG-X compound nondiffusible in a photographic element during development in an alkaline processing composition. Particularly useful ballast groups include long chain alkyl groups (e.g. 6 to 30 carbon atoms), as well as aromatic groups (phenyl, naphthyl) along with alkyl groups. Representative ballast groups include $-CO-C_{11}H_{23}$, $-CO-C_6H_4(t\text{-}C_{12}H_{25})$, $-CON(C_{12}H_{25})_2$,

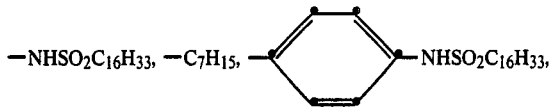

$-NHSO_2C_{16}H_{33}$, $-C_7H_{15}$, $-NHSO_2C_{16}H_{33}$,

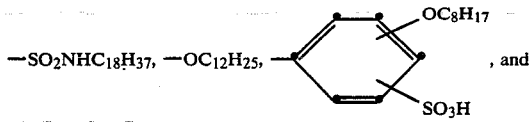

$-SO_2NHC_{18}H_{37}$, $-OC_{12}H_{25}$, , and

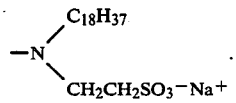

X can be monomeric, or it can form part of a dimeric, oligomeric or polymeric coupler, in which case more than one LIG group can be coupled to X. Useful polymeric X groups to which LIG moieties are appended are described in copending and commonly assigned U.S. Ser. No. 688,224, noted above, filed by myself and K. R. Hollister.

The LIG moiety is joined to X at any of the positions from which groups cleaved from couplers by reaction with oxidized developing agent can be attached. Preferably, LIG is attached to X in a coupling position so that upon reaction of the coupler with oxidized developing agent, LIG will be cleaved from X in imagewise exposed areas of the element. However, LIG can be in a non-coupling position of X, from which position it will be cleaved as a result of reaction of X with oxidized developing agent. In the case where the LIG moiety is in a non-coupling position, other groups can be in the coupling position, including the conventional coupling off groups or the same or a different LIG moiety. Accordingly, the LIG-X compounds useful in this invention can provide more than one mole of LIG per mole of compound. The LIG moieties can be the same or different and can be cleaved at the same or different times or rates.

LIG and X are connected with a single bond or with an organic linking moiety which generally remains with LIG when it is cleaved and is protonated or ionized depending upon the pKa of the group. Useful organic linking moieties include —COO—, —CONH—, —O—, —S—, $-SO_2-$, $-SO_2NH-$, $-CH_2CO-$, $-SO_2N$-(Alkyl)— and the like as well as the timing groups described in U.S. Pat. No. 4,248,962 (issued Feb. 3, 1981 to Lau), the disclosure of which is incorporated herein by reference. A particularly useful linking group is a single bond or —O—.

Also useful in the practice of this invention as X moieties are the following color coupler moieties:

I.

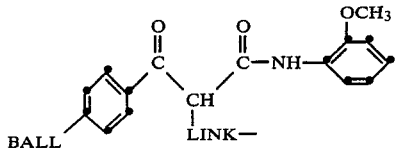

II.

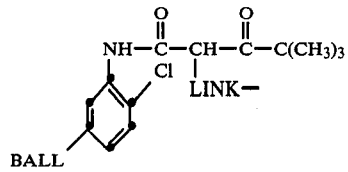

III.

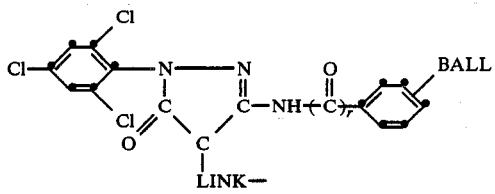

wherein r is 0 or 1,

IV.

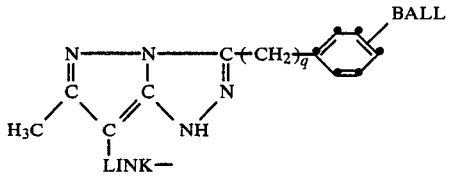

wherein q is an integer of 1 to 20;

V.

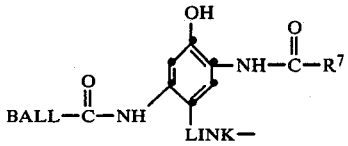

wherein $R^7$ is substituted or unsubstituted alkyl (preferably of 1 to 20 carbon atoms) or substituted or unsubstituted aryl (preferably of 6 to 14 carbon atoms),

VI.

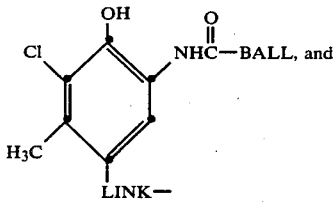

VII.

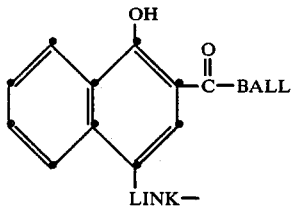

In these formulae, BALL is any suitable ballast group as described above (e.g. $-NHSO_2C_{16}H_{33}$, —NHCO-alkylene-oxy-aryl, alkyl of 1 to 20 carbon atoms, aryl of 6 to 14 carbon atoms in the nucleus, etc.), and LINK is a suitable linking moiety, as described above, which links X and LIG prior to reaction with oxidized developing agent. BALL can also be a suitable polymer backbone.

Representative LIG-X compounds useful in the practice of this invention include the following:

N-{{4-chloro-3-{4,4-dimethyl-3-oxo-2-[4'-(2,2':6', 2''-terpyridyl)oxy]pentanamido}phenyl}}-hexadecanesulfonamide, a magenta dye-providing compound, 1-hydroxy-N-[4-(2,4-di-t-pentylphenoxy)butyl]-4-[4'-(2,2':6',2''-terpyridyl)oxy]-2-naphthamide, a magenta dye-providing compound, 4-{{4,4-dimethyl-3-oxo-2-{3-[4'-(2,2':6',2''-terpyridyl)]phenoxy}pentanamido}}-N-methyl-N-octadecylbenzenesulfonamide, a magenta dye-providing compound, 1-hydroxy-4-{{{4-nitro-2-{{N-isopropyl-N-{4-[(6-phenyl-3-(2-pyridyl)-1,2,4-triazin-5-yl]phenoxycarbonyl}aminomethyl}}phenoxy}}}-N-(2-tetradecyloxyphenyl)-2-naphthamide, a magenta dye-providing compound, and 1-hydroxy-N-[4-(2,4-di-t-pentylphenoxy)butyl]-4-{{{4-{{N-{2-[4'-(2,2':6',2''-terpyridyl)oxy]-ethyl}sulfamoyl}}phenoxy}}}-2-naphthamide, a magenta dye-providing compound.

The LIG-X compounds useful in the practice of this invention can be readily prepared using chemical reactions known to one skilled in photographic chemistry. Generally, a compound from which the LIG moiety is derived is reacted with a compound (e.g. a colorless color coupler) from which X can be derived. Detailed syntheses of exemplary LIG-X compounds are provided below.

In preferred embodiments, the following general preparatory techniques can be used:

(a) Reaction of a LIG moiety containing a hydroxy group with a color coupler containing a leaving group (e.g. halogen, tosylate, mesylate, sulfonium salt, etc.) in the coupling off position to produce a LIG-X compound of the invention having the LIG moiety bonded to the X coupler moiety through an —O— linkage. Alternatively, a LIG moiety having a mercapto group could be used to obtain a LIG-X compound having the LIG and X moieties linked through an —S— linkage.

(b) Reaction of a color coupler having a hydroxy group with a LIG moiety containing a leaving group (as defined above) to produce the same kind of LIG-X compound as described in (a).

In other embodiments, LIG-X compounds useful in this invention can be prepared by condensation of a LIG-containing carboxylic acid halide or sulfonic acid halide with a color coupler containing a hydroxy, mercapto or amino group in the coupling position to produce LIG-X compounds having LIG and X moieties joined by an ester, amide, sulfonamide or thioester linkage.

As noted above, LIG is a moiety capable of complexing with metal ions to provide desired dyes in one or more layers of photographic elements. A variety of metal ions can be so used as long as the complex of the LIG moiety with the metal ion is stable, or in other words, the complex is likely to remain in complexed form for a substantial period of time. In general, the log of the formation constant of such complexes should be in the range of from about 10 to about 30, and preferably from about 15 to about 25. Useful metal ions include $Fe^{++}$, $Co^{++}$, $Cu^{+}$, $Cu^{++}$, $Ru^{++}$ and $Os^{++}$. Ferrous ions are preferred in the practice of this invention.

In the practice of this invention, cleavage of LIG from X results from reaction of oxidized developing agent with the LIG-X compound. Any suitable developing agent can be used in the practice of this invention, which when oxidized from silver halide development, can react with LIG-X. Particularly useful developing agents are color developing agents, including aminophenols, phenylenediamines, tetrahydroquinolines and the like as described, for example, in *Research Disclosure,* publication 17643, paragraph XX, noted above. Other useful developing agents include hydroquinones, catechols and pyrazolidones.

The photographic elements of this invention can be processed by conventional techniques in which the processing solutions or compositions are incorporated in the element or are separately applied in a solution or process sheet. These solutions or compositions contain developing agents (e.g. color developing agent) and other conventional processing addenda, as well as metal ions to complex with LIG, if desired. Alternatively, the metal ions can be incorporated within the element in the same or different layer as the LIG-X compound. More specifically, processing of the elements of this invention can be accomplished by treating an imagewise exposed element containing LIG-X with an alkaline processing solution containing a color developing agent (and another developing agent, if desired) to form an imagewise distribution of LIG moiety which is washed out of the element. The remaining LIG-X in unexposed areas is treated with metal ions to provide a color dye in those areas. The ferrous or other metal ions can be included in the bleach solution for complexation with LIG-X.

Photographic elements of this invention in which the described LIG-X compounds are incorporated can comprise a support and one or more silver halide emulsion layers and associated dye-providing layers. The LIG-X compounds can be incorporated in the silver halide emulsion layer or in another layer, such as an adjacent layer, where they will come into reactive association with oxidized color developing agent which has developed silver halide in the emulsion layer. The silver halide emulsion layer can contain, or have associated with it, photographic coupler compounds, such as color forming couplers, etc. These coupler compounds can form dyes of the same or different color or hue as the masking dyes formed by complexation of LIG and metal ions. Additionally, the silver halide emulsion layer can contain addenda conventionally contained in such layers.

A multilayer, multicolor photographic element of this invention can comprise a support having thereon a red-sensitive silver halide emulsion unit having associated therewith a cyan dye image providing material, a green-sensitive silver halide emulsion unit having associated therewith a magenta dye image providing material and a blue-sensitive silver halide emulsion unit having associated therewith a yellow dye image-providing material, at least one of the silver halide emulsion units having associated therewith a LIG-X compound. Each silver halide emulsion unit can be composed of one or more layers and the various units and layers can be arranged in different locations with respect to one another as is known in the art. The LIG-X compounds described herein can be incorporated into or associated with one or more units or layers of the element. Preferably, the LIG-X compound can provide a magenta masking dye in either the red-sensitive or blue-sensitive silver halide emulsion units.

The light sensitive silver halide emulsions can include coarse, regular or fine grain silver halide crystals or mixtures thereof and can be comprised of such silver halides as silver chloride, silver bromide, silver bromoiodide, silver chlorobromide, silver chloroiodide, silver chlorobromoiodide and mixtures thereof. The emulsions can be negative-working or direct-positive emulsions. They can form latent images predominantly on the surface of the silver halide grains or predominantly on the interior of the grains. They can be chemically and spectrally sensitized. The emulsions generally are gelatin-containing emulsions although other natural or synthetic hydrophilic colloids, soluble polymers or mixtures thereof can be used if desired.

The element support can be any suitable substrate used in photographic elements. Examples of such supports include films of cellulose nitrate, cellulose acetates, poly(vinyl acetal), polyesters [e.g. poly(ethylene terephthalate)], polycarbonates and other resinous materials; glass; metals; paper; and the like. Generally, a flexible paper or resinous film support is used, and a paper support is particularly useful. Paper supports can be acetylated or coated with baryta and/or an α-olefin polymer such as polyethylene, polypropylene, ethylene-butene copolymer and the like.

Further details regarding silver halide emulsions and photographic elements are well known in the art as described, for example, in *Research Disclosure,* publication 17643, noted above.

PREPARATION 1

A useful magenta masking dye-forming LIG-X compound is N-{{4-chloro-3-{4,4-dimethyl-3-oxo-2-[4'-(2,2':6',2''-terpyridyl)oxy]pentanamido}phenyl}}hexadecanesulfonamide which was prepared in the following manner:

The following were added to a 25 ml flask equipped with a stirrer: 0.5 g (2 mmol) of 2,6-di-2-pyridyl-4-hydroxypyridine, 0.43 g (3.75 mmol) of tetramethylguanidine, 5 mL of $CH_3CN$ and 1.5 g (2.7 mmol) of N-[4-chloro-3-(2-chloro-4,4-dimethyl-3-oxopentanamido)phenyl]hexadecanesulfonamide. The resulting mixture was heated at 40° C. with stirring for one hour. A thin layer chromatography analysis (10% EtOAc/$CH_3CN$) revealed that starting terpyridine remained, so another 0.3 g of the hexadecanesulfonamide and 0.1 g of tetramethylguanidine were added to the mixture. The reaction mixture was stirred an additional five hours whereupon the solvent was removed. The residue was chromatographed on silica gel. Nonpolar degradation products of the coupler were eluted with 10% cyclohexane/$CH_2Cl_2$ up to $CH_2Cl_2$. The desired LIG-X compound was eluted with 10% EtOAc/$CH_2Cl_2$ up to 50% $CH_2Cl_2$/EtOAc. Removal of the solvent left 0.8 g of a glassy solid identified as the desired magenta masking dye by mass spectroscopy.

PREPARATION 2

A similar magenta masking dye-forming LIG-X compound, 1-hydroxy-N-[4-(2,4-di-t-pentylphenoxy)butyl]-4-[4'-(2,2':6',2''-terpyridyl)oxy]-2-naphthamide, was prepared in the following manner:

NaH (50%, 50 mmol) was added, in portions, to a solution of 1,4-dihydroxy-N-[4-(2,4-di-t-pentylphenoxy)butyl]-2-naphthamide (12.5 g, 25 mmol), 2,6-di-2-pyridyl-4-methylsulfonopyridine (3.1 g, 10 mmol) and dry N,N-dimethylformamide (100 ml) under nitrogen. After hydrogen evolution was complete, the solution was heated to 90° C. for two hours. Thin layer chromatography (9/1 $CH_3CN$/MeOH) revealed that all of the sulfone was consumed in reaction. The reaction mixture was poured into 2000 ml of dilute monopotassium phosphate buffer. After removal of the solvent, the crude product was triturated several times with cyclohexane to remove unreacted starting material. About 9 g of the desired tan, solid LIG-X compound was obtained. Analysis by mass spectroscopy showed the compound to be consistent with the assigned structure.

PREPARATION 3

A useful magenta masking dye-forming LIG-X compound is 4-{{4,4-dimethyl-3-oxo-2-{3-[4'-(2,2':6',2''-terpyridyl)]phenoxy}pentanamido}}-N-methyl-N-octadecylbenzenesulfonamide which was prepared in the following manner.

To a solution of 1.4 ml of triethylamine (2 equiv.) in 100 ml of dry acetonitrile were added 3 g of

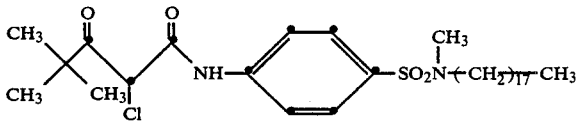

and 1.63 g of

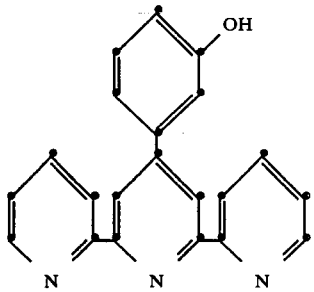

The resulting reaction mixture was refluxed under argon for 24 hours. Upon cooling, 2.5 g of a white solid was collected by filtration. The material showed one spot on thin layer chromatography and possessed i.r., n.m.r., and mass spectra consistent with the assigned structure.

PREPARATION 4

Another useful magenta masking dye-forming LIG-X compound is 1-hydroxy-4-{{{4-nitro-2-{{N-isopropyl-N-{4-[6-phenyl-3-(2-pyridyl)-1,2,4-triazin-5-yl]phenoxycarbonyl}aminomethyl}}-phenoxy}}}-N-(2-tetradecyloxyphenyl)-2-naphthamide which was prepared in the following manner.

The reactants

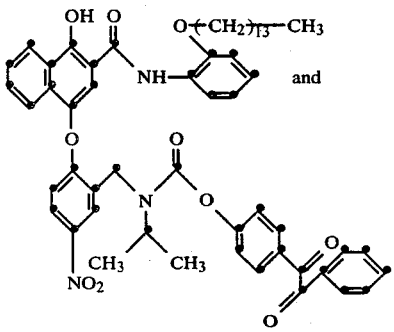

and

-continued

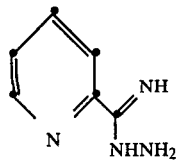

were combined (2.5 g and 0.37 g, respectively) in 100 ml of ethanol and refluxed under argon overnight. Upon cooling to room temperature, the product oiled out. Slow evaporation of the solvent and grinding with a stirring rod caused the product to solidify. Recrystallization from isopropanol afforded 1.70 g of buff yellow solid showing a one spot thin layer chromatography with a very slight trace of the first reactant and i.r., n.m.r., and mass spectra consistent with the assigned structure.

PREPARATION 5

Another useful magenta masking dye-forming LIG-X compound is 1-hydroxy-N-[4-(2,4-di-t-pentylphenoxy)-butyl]-4-{{{4-{{N-{2-[4'-(2,2':6',2''-terpyridyl)oxy]ethyl}sulfamoyl}}phenoxy}}}-2-naphthamide which was prepared in the following manner.

To a solution of 0.584 g of

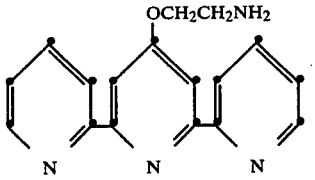

and 0.4 g of dry triethylamine in 100 ml of tetrahydrofuran was added a solution of 1.33 g of

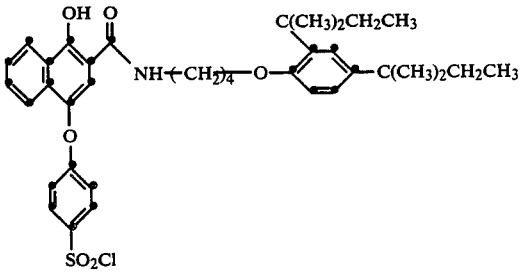

in 20 ml of tetrahydrofuran. After total addition, the reaction mixture was stirred at room temperature for two hours. The resulting $Et_3N.HCl$ was filtered off, 0.5 ml of glacial acetic acid was added and the filtrate was reduced to dryness. The residue was taken up in $CH_2Cl_2$, washed with 1 normal acetic acid, water, and brine and then dried over $Na_2SO_4$. The $CH_2Cl_2$ was removed in vacuo and the resulting material redissolved in ethyl ether and evaporated to dryness to afford 1.69 g of a fluffy white solid having i.r., n.m.r., and mass spectra consistent with the assigned structure.

The following examples are provided to illustrate the practice of this invention.

EXAMPLE 1

This example illustrates the use of a LIG-X compound to correct for undesired green absorption of a cyan dye in a photographic element.

A 1:1 molar ratio of a conventional cyan dye-providing color coupler, N-[N'-(4-cyanophenyl)ureido-3-hydroxyphenyl]-2-(2,4-di-t-pentylphenoxy)hexanoic acid amide and a colorless magenta dye-providing LIG-X compound, 1-hydroxy-N-[4-(2,4-di-t-pentylphenoxy)butyl]-4-[4'-(2,2':6',2''-terpyridyl)oxy]-2-naphthamide, dissolved in half their weight of dibutyl phthalate and three times their weight of ethyl acetate was coated in a silver bromoiodide emulsion on a cellulose acetate support. The coating levels were 0.48 g/m$^2$ of magenta dye-providing LIG-X compound, 0.58 g/m$^2$ of a conventional cyan dye-providing color coupler, 0.9 g/m$^2$ of Ag and 3.8 g/m$^2$ of gelatin.

The resulting element was imagewise exposed, developed with a phenylenediamine color developing solution (pH 10) and bleached using a ferricyanide-based bleach solution. This process provided a cyan dye image in the exposed areas and cleaved the terpyridyl LIG moiety from the X moiety in those areas. The free LIG moiety was washed out of the element in the processing solutions. The element was then placed into a dilute ammonium ferrous sulfate solution ($10^{-3}$ molar), providing ferrous ions which complexed with the LIG moiety of the uncoupled LIG-X compound, generating a magenta color correcting dye in the unexposed areas of the element.

EXAMPLE 2

This example illustrates the use of a LIG-X compound to correct for undesired green absorption of a yellow dye in a photographic element.

A 1:3 molar ratio of a magenta dye-providing LIG-X compound, N-{{4-chloro-3-{4,4-dimethyl-3-oxo-2-[4'-(2,2':6',2''-terpyridyl)oxy]pentanamido}phenyl}}hexadecanesulfonamide, and a conventional yellow dye-providing color coupler having the structure:

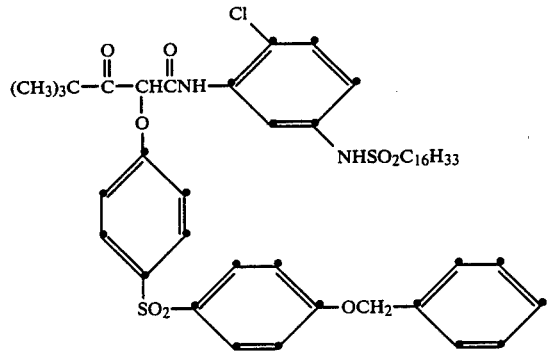

were coated in a silver halide emulsion on a cellulose acetate support after being dissolved in half their weight of dibutyl phthalate and three times their weight of ethyl acetate. The coating levels were 1.8 g/m$^2$ of magenta dye-providing LIG-X compound, 5.9 g/m$^2$ of conventional yellow dye-providing color coupler, 2.5 g/m$^2$ of Ag and 12.4 g/m$^2$ of gelatin.

The resulting element was imagewise exposed, developed and bleached as described in Example 1 to provide a cyan dye image. Uncoupled LIG moiety was washed out of the exposed areas. The element was then treated with ferrous ions as in Example 1. The ferrous ions complexed with the LIG moiety of the uncoupled LIG-X compound, generating a magenta color correcting dye in the unexposed areas of the element.

The invention has been described in detail with particular reference to preferred embodiments thereof, but it will be understood that variations and modifications can be effected within the spirit and scope of the invention.

I claim:

1. A photographic element comprising a support having thereon at least one silver halide emulsion layer having associated therewith a compound for providing a dye image in exposed areas of said element, and an essentially colorless, immobile, ligand-releasing compound of the structure LIG-X wherein X is a group which, as a function of silver halide development is cleaved from LIG, and LIG is a ligand capable of complexing with metal ions while joined to X to form a color dye image in the unexposed areas of said element.

2. The element of claim 1 wherein X is a coupler moiety and LIG is joined to the coupling position thereof so that, upon reaction of said coupler moiety with oxidized color developing agent, LIG is cleaved from X.

3. The element of claim 1 wherein LIG is derived from a compound having the structure:

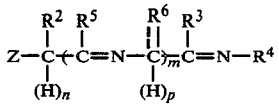

wherein m is 0 or a positive integer of 1 to 3, n and p are independently 0 or 1, ═ represents a single or double bond, Z is $R^1$—N═, O═, S═, $R^1$—P═, $(R^1)_2P$— or $(R^1)_3P$═, and when Z is $(R^1)_2P$—, n is 1, otherwise n is 0, $R^1$, $R^2$, $R^3$, $R^4$, $R^5$ and $R^6$ are independently hydrogen, amino, hydroxy, mercapto, alkoxy, alkyl, aryl or a heterocyclic moiety, and when $R^6$ is so defined, p is 1 and ═ is a single bond, if m is 0, $R^1$ and $R^2$, $R^2$ and $R^3$, and $R^3$ and $R^4$, taken together, can independently represent the carbon and heteroatoms necessary to complete a substituted or unsubstituted carbocyclic or heterocyclic nucleus, or, if m is 1 to 3, $R^1$ and $R^2$, $R^5$ and $R^6$, and $R^3$ and $R^4$, taken together, can independently represent the carbon and heteroatoms necessary to complete a substituted or unsubstituted heterocyclic nucleus, and when $R^5$ and $R^6$ are so defined, p is 0 when ═ is a double bond, and p is 1 when ═ is a single bond.

4. The element of claim 3 wherein m is 0 or 1 and Z is $R^1$—N═.

5. The element of claim 1 wherein X is derived from a color coupler compound.

6. A multilayer photographic element comprising a support having thereon a red-sensitive silver halide emulsion unit having associated therewith a cyan dye image-providing material, a green-sensitive silver halide emulsion unit having associated therewith a magenta dye image-providing material and a blue-sensitive silver halide emulsion unit having associated therewith a yellow dye image-providing silver halide material, said element having associated with at least one of said units an essentially colorless, immobile, ligand-releasing compound of the structure LIG-X wherein X is a group which, as a function of silver halide development, is cleaved from LIG, and LIG is a ligand capable of complexing with metal ions while joined to X to form a color dye image in the unexposed areas of said element.

7. The element of claim 6 wherein LIG is derived from a compound having the structure:

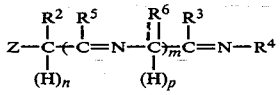

wherein m is 0 or a positive integer of 1 to 3, n and p are independently 0 or 1, ═ represents a single or double bond, Z is $R^1$—N═, O═, S═, $R^1$—P═, $(R^1)_2P$— or $(R^1)_3P$═, and when Z is $(R^1)_2P$—, n is 1, otherwise n is 0, $R^1$, $R^2$, $R^3$, $R^4$, $R^5$ and $R^6$ are independently hydrogen, amino, hydroxy, mercapto, alkoxy, alkyl, aryl or a heterocyclic moiety, and when $R^6$ is so defined, p is 1 and ═ is a single bond, if m is 0, $R^1$ and $R^2$, $R^2$ and $R^3$, and $R^3$ and $R^4$, taken together, can independently represent the carbon and heteroatoms necessary to complete a substituted or unsubstituted carbocyclic or heterocyclic nucleus, or, if m is 1 to b 3, $R^1$ and $R^2$, $R^5$ and $R^6$, and $R^3$ and $R^4$, taken together, can independently represent the carbon and heteroatoms necessary to complete a substituted or unsubstituted heterocyclic nucleus, and when $R^5$ and $R^6$ are so defined, p is 0 when ═ is a double bond, and p is 1 when ═ is a single bond.

8. The element of claim 6 wherein LIG-X provides a magenta dye image in said unexposed areas.

9. The element of claim 8 wherein said magenta dye image is provided by a complex of ferrous ions and 1-hydroxy-N-[4-(2,4-di-t-pentylphenoxy)butyl]-4-[4'-(2,2':6',2''-terpyridyl)oxy]-2-naphthamide.

10. The element of claim 6 wherein said LIG-X forms a color dye image with ferrous ions.

11. A process of color correction in an imagewise exposed element of claim 1, said process comprising the steps of:

(a) developing the imagewise exposed areas of said element with a color developing agent, thereby cleaving LIG from X and washing substantially all of the cleaved LIG out of said element; and (b) treating said element with metal ions to form a color masking dye with LIG-X in the unexposed areas of said element.

12. The process of claim 11 wherein said color masking dye is a magenta dye.

13. The process of claim 11 wherein said metal ions are ferrous ions.

14. The process of claim 11 wherein LIG is derived from a compound having the structure:

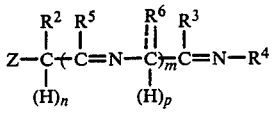

wherein m is 0 or a positive integer of 1 to 3, n and p are independently 0 or 1, ⚌ represents a single or double bond, Z is $R^1$—N═, O═, S═, $R^1$—P═, $(R^1)_2P$— or $(R^1)_3P$═, and when Z is $(R^1)_2P$—, n is 1, otherwise n is 0, $R^1$, $R^2$, $R^3$, $R^4$, $R^5$ and $R^6$ are independently hydrogen, amino, hydroxy, mercapto, alkoxy, alkyl, aryl or a heterocyclic moiety, and when $R^6$ is so defined, p is 1 and ⚌ is a single bond, if m is 0, $R^1$ and $R^2$, $R^2$ and $R^3$, and $R^3$ and $R^4$, taken together, can independently represent the carbon and heteroatoms necessary to complete a substituted or unsubstituted carbocyclic or heterocyclic nucleus, or, if m is 1 to 3, $R^1$ and $R^2$, $R^5$ and $R^6$, and $R^3$ and $R^4$, taken together, can independently represent the carbon and heteroatoms necessary to complete a substituted or unsubstituted heterocyclic nucleus, and when $R^5$ and $R^6$ are so defined, p is 0 when ⚌ is a double bond, and p is 1 when ⚌ is a single bond.

15. The process of claim 14 wherein m is 0 or 1 and Z is $R^1$—N═.

* * * * *